United States Patent [19]

Miller

[11] 4,280,596

[45] Jul. 28, 1981

[54] AIR BRAKE ARRANGEMENT FOR CENTER SILL-LESS HOPPER CARS

[75] Inventor: Roy W. Miller, Highland, Ind.

[73] Assignee: Pullman Incorporated, Chicago, Ill.

[21] Appl. No.: 80,843

[22] Filed: Oct. 1, 1979

[51] Int. Cl.[3] ..... B61H 13/00

[52] U.S. Cl. ..... 188/52; 105/247

[58] Field of Search ..... 188/49, 50, 51, 52, 188/53, 54, 55, 56; 105/240, 247, 248

[56] References Cited

U.S. PATENT DOCUMENTS

| | | | |
|---|---|---|---|
| 656,516 | 8/1900 | Clark | 188/52 X |
| 2,095,624 | 10/1937 | Young . | |
| 2,788,865 | 4/1957 | Kolesa . | |
| 3,184,000 | 5/1965 | Radey . | |
| 3,372,779 | 3/1968 | Roselius et al. | 188/52 X |
| 3,378,112 | 4/1968 | Roselius et al. | 188/52 X |
| 3,533,492 | 10/1970 | Campbell | 188/52 X |
| 3,605,635 | 8/1971 | Stark | 105/248 |
| 3,828,948 | 8/1974 | Peterson | 105/240 X |
| 4,136,760 | 1/1979 | Sander | 188/56 |

FOREIGN PATENT DOCUMENTS

| | | | |
|---|---|---|---|
| 60068 | 11/1967 | Fed. Rep. of Germany | 188/51 |
| 928887 | 6/1947 | France | 188/56 |

*Primary Examiner*—George E. A. Halvosa

*Attorney, Agent, or Firm*—Richard J. Myers; Paul A. Kerstein

[57] ABSTRACT

A center sill-less hopper car is provided with a body-mounted brake arrangement using a conventional brake beam and brake system. The arrangement includes the mounting of the individual components in a manner which accommodates the operation of the discharge gates of the hopper in discharging material downwardly from the car.

16 Claims, 4 Drawing Figures

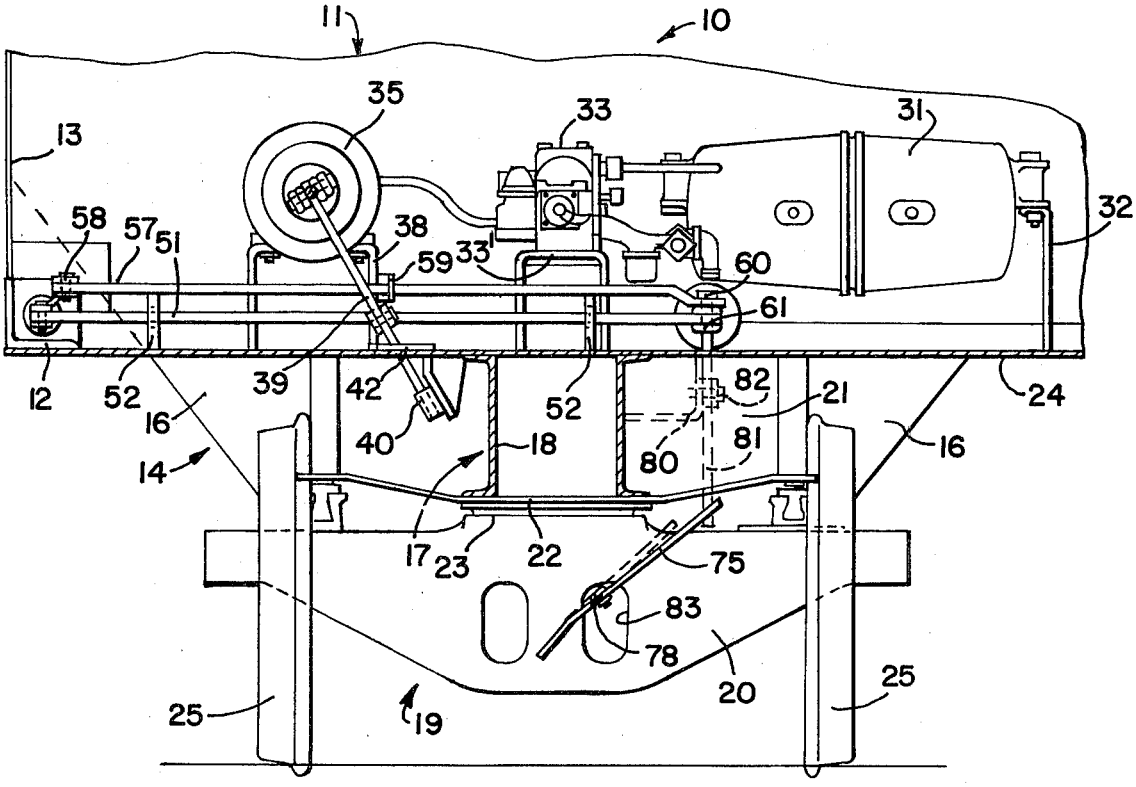
FIG. 3
FIG. 4
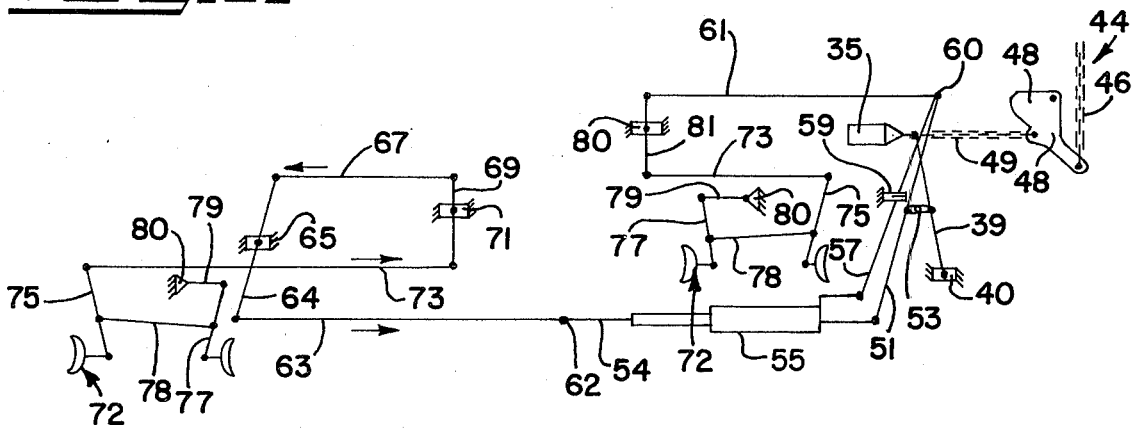

AIR BRAKE ARRANGEMENT FOR CENTER SILL-LESS HOPPER CARS

BACKGROUND OF THE INVENTION

1. Field of the Invention

The invention pertains to the field of railway car brakes and more specifically to a car body mounted brake arrangement which is utilized with a center sill-less hopper car.

2. Description of the Prior Art

The prior art includes U.S. Pat. No. 2,788,865 which discloses the mounting of air brake cylinder levers and pull rods at the elevated end portion of the underframe of a rail car. U.S. Pat. No. 2,095,624 discloses the construction of various shelves to support air brake cylinder levers and pull rods. U.S. Pat. No. 3,184,000 shows a foundation brake rigging system wherein the brake connecting levers are mounted beneath the axles of the truck wheels. The present arrangement is an improvement over the constructions shown in the aforementioned patents. In sill-less hopper cars the wheel trucks utilized have usually been provided with conventional truck-mounted brakes since the foundation type of brake rigging, or the so-called body mounted brake, was not perceived to be practical because of the structure of the sill-less railway hopper car. The sill-less hopper car includes stub sills at opposite ends thereof and is provided with suitable downwardly or sidewardly opening doors for discharging the material from the car. Because of clearance and location problems it was believed that this would prevent the use of the body mounted brake system and accordingly the truck mounted braking systems were utilized. These are expensive and require additional air lines to operate. The present arrangement provides for a foundation brake system for a sill-less hopper car utilizing a novel arrangement of the braking components.

SUMMARY OF THE INVENTION

In the present sill-less hopper car construction the actuating components of the improved braking system are positioned on the shear plate or horizontal supporting plate provided at the B end of the car. This end, therefore, is provided with the air reservoir, the ABD control valve, and the air cylinder for actuating the brakes. Associated with the air cylinder is a hand brake system which is utilized to apply the brakes for parking or when the car is positioned on an inclined track. The air cylinder actuates a vertical cylinder lever which in turn is functional to move a horizontal floating lever adapted to actuate brake actuating rods extending in a manner where they do not interfere with the downwardly projecting hopper. Thus one of the brake actuating rods runs along the top of the side sill of the car and is connected at its end to a horizontal lever positioned at the A end of the car. The horizontal lever is also supported on the A end shear plate and is functional to actuate a vertical lever positioned for swinging movement below one of the inclined end hopper sheets of the hopper car. The vertical lever in turn is functional to actuate a brake operating link or rod extending substantially horizontal and being connected to a live lever of a brake beam and brake system conventional in foundation brake riggings. The live lever is connected to a brake lever connecting rod which in turn is connected to a dead lever having a suitable anchoring link mounted or supported on the car body. At the B end of the car a similar brake beam and brake arrangement is provided, the same also being actuated by means of a brake actuating link in turn connected for operation to another vertical lever which in turn is moved by the horizontal floating lever supported on the shear plate at the B end of the car. Thus the arrangement is such that the horizontal and vertical levers are strategically positioned in a manner where there is no interference with the dump door operation and yet the advantages of a foundation or body mounted brake system are achieved.

BRIEF DESCRIPTION OF THE DRAWINGS

FIG. 3 is a cross-sectional view taken substantially along line 3—3 of FIG. 1;

FIG. 4 is a body diagram of the braking arrangement.

DESCRIPTION OF THE PREFERRED EMBODIMENT

Figure 1:
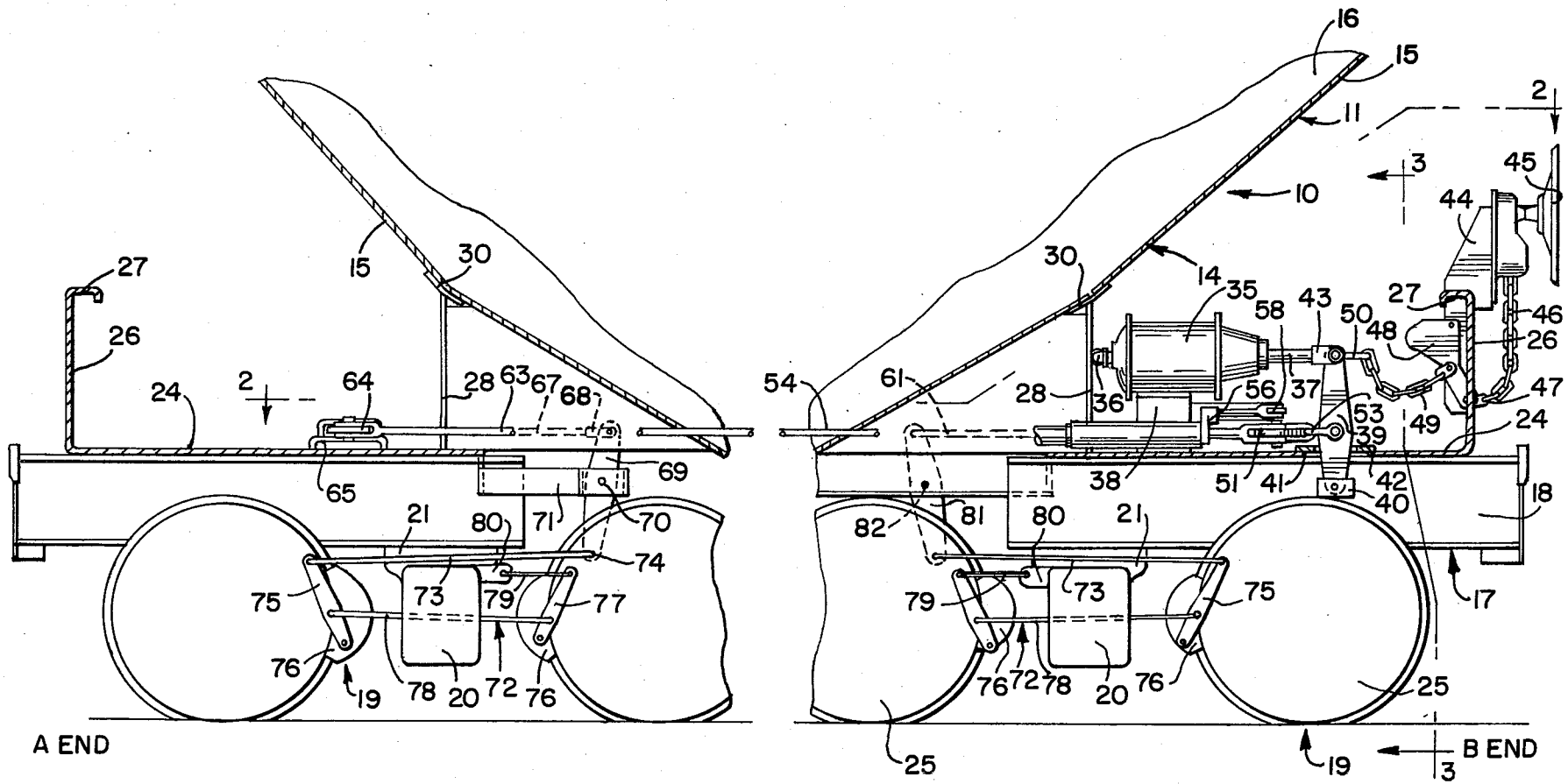
FIG. 1 is a cross-sectional side view of a sill-less hopper car disclosing a novel body mounted braking system.
Figure 2:
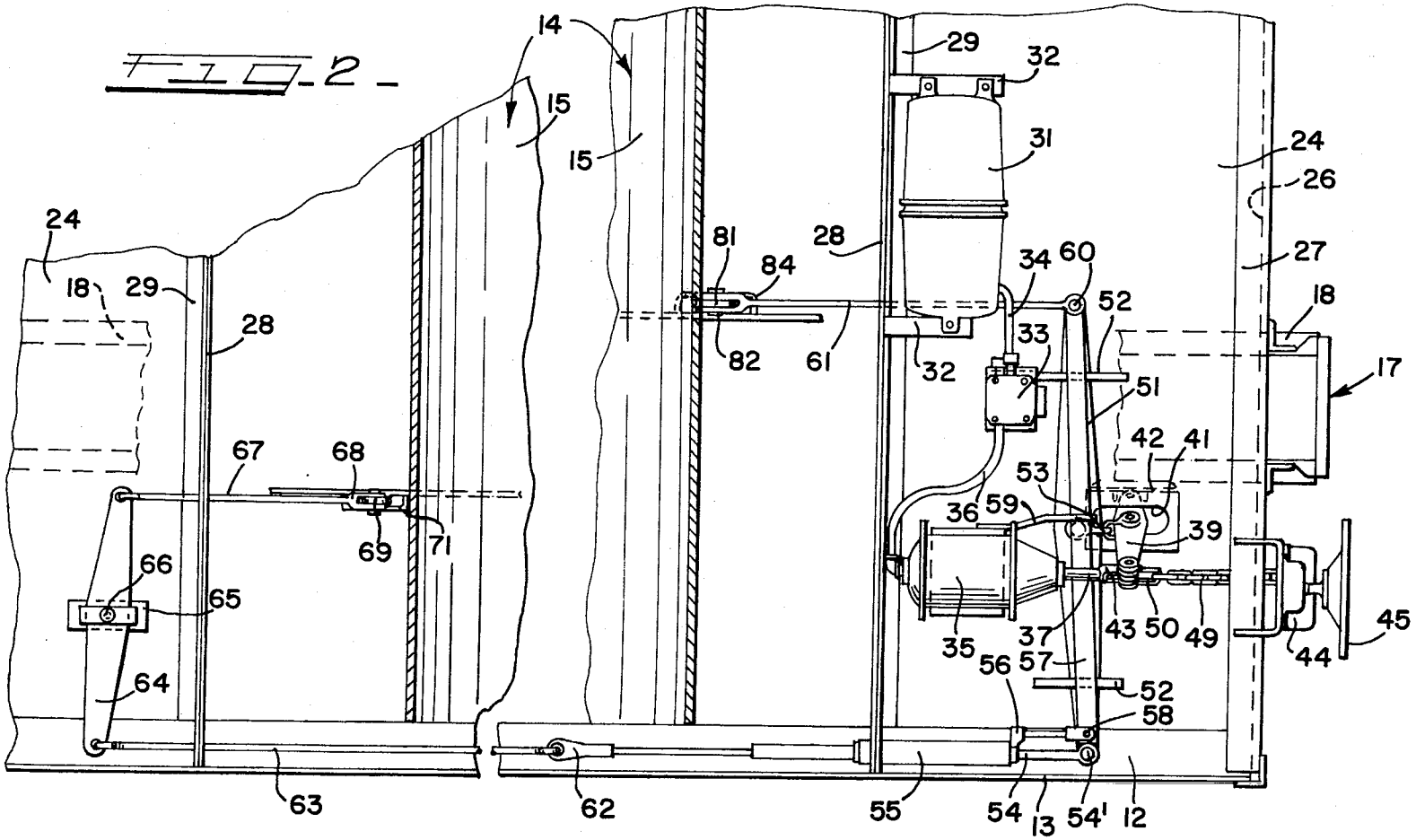
FIG. 2 is a view taken substantially along the line 2—2 of FIG. 1.

FIGS. 1, 2 and 3 disclose a sill-less railway hopper car 10 comprising a body 11 having longitudinally extending and laterally spaced side sills 12, only one side being shown. The body 11 includes vertically extending side walls 13 and a hopper structure on the body 11 generally designated at 14. The hopper structure comprises downwardly and inwardly sloping end walls 15 suitably provided with lower sloping side walls 16 terminating in a suitable discharge opening (not shown) through which the discharge of materials from the car downwardly and outwardly is achieved by conventional bottom dump door arrangement. The sill-less hopper car of this type is generally provided with an underframe 17 comprising stub sills 18 disposed at opposite ends of the car and extending substantially a short length inwardly from the A and B ends of the car.

As best shown in FIG. 3, wheel trucks 19, each of which includes a truck bolster 20, provide support for the underframe 17 and stub sills 18. This is achieved by a body bolster 21 having a body center plate 22 seated in the bowl or bolster center plate portion 23 of each of the wheel trucks 19. The side sills 12 and underframe 17 support, at opposite ends of the car, a shear plate or horizontal support member 24. The wheel trucks 19 are provided with conventional car wheels 25 and include conventional side frames and spring arrangement not shown since it forms no part of the present invention. As best shown in FIG. 1, each of the shear plates 24 is provided with a vertical and transversely extending plate 26 provided at its upper end with a horizontal and downwardly projecting flange 27. The shear plates 24 also support vertically extending plate members 28 having at their upper ends saddle gussets 30 which support portions of the downwardly and inwardly extending end walls 15 forming a portion of the hopper structure. As best shown in FIG. 2 each of the vertical support plates 28 is secured to the lower shear plate by the means of an angle member 29.

As best shown in FIG. 1 and FIG. 2, the B end of the car provides for the installation of the various components of the actuating system for the brake arrangement. An air reservoir of conventional construction is designated at 31 and is mounted on support brackets 32, in turn supported on the horizontal shear plate 24. Adjacent to the air reservoir is a control valve 33 suitably mounted on valve support brackets 33'. An air line 34 extends from the control valve 33 to the air reservoir 31 for supplying air to the control valve. A brake cylinder 35 is positioned and supported on the shear plate 24 by means of bracket supports 38. The brake cylinder is connected by means of an air line 36 to the control valve 33. A piston rod 37 is reciprocable on the brake cylinder 35 in conventional manner and is pivoted at its lower end about a bracket 40 which as best shown in FIG. 3 is supported on and extends downwardly from the shear plate 24. The lever 39 extends through an opening 41 provided in the shear plate 24 and the said opening is reinforced by means of an apertured guide plate 42 as best shown in FIG. 2. The piston rod 37 is provided with a clevis 43 which is pivotally connected to the upper end of the lever 39.

The B end of the car also contains a conventional handbrake 44 of the ratchet type, having a hand wheel 45. Handbrakes of this type are conventional in the art and need not be further described except that it includes a chain connection 46 which at one end is pivotally connected to a swinging lever 48 adapted to pivot on the handbrake structure which is in turn pivotally connected to another chain 49 connected to the clevis 43 and lever 39 by means of a clevis connection 50.

As best shown in FIGS. 2 and 3 a horizontal floating lever 51 is movable within guides 52 suitably supported on the shear plate 24.

The lever 51 is pivotally connected to a double clevis 53 mounted substantially midway on the lever 39 and during the movement of said lever, in response to movement of rod 37, the floating lever is moved in a horizontal direction. An elongated actuating rod 54 suitably includes a slack adjustor mechanism 55 which by means of a connection 56 is connected to a slack adjustor lever 57. The connection 56 is connected to the slack adjustor lever 57 by means of a pivot 58. A suitable guide bracket 59 projects outwardly from the cylinder 35 and is suitably slotted to slidingly support the slack adjustor lever 57. The slack adjustor is of a conventional type, readily available on the market, and need not be further described since it merely forms a standard part of a foundation or body mounted brake system. The slack adjustor lever 57 is also pivotally connected at its innermost end, as indicated at 60, to a rod 61 extending longitudinally substantially midway of the car. The elongated actuating rod 54 and slack adjustor 55 are provided at one end as best shown in FIG. 2 with a connector 62 which pivotally connects to another rod 63 providing an extension of the rod 54. The front end of the rod 54 is pivotally connected as indicated 54' to the floating lever 51. The rod 63 is connected to a horizontal lever 64 provided at the A end of the car, the said lever being mounted on the shear plate 24 pivotally as indicated at 66 by means of a bracket 65. An actuating rod 67 is pivotally connected to the horizontal lever 64, includes a clevis 68 at one end which is in pivotal connection with a vertical lever 69, as best shown in FIG. 1, and is pivotally supported by means of a pivot 70 on a bracket 71, the said bracket 71 being suitably supported by the shear plate and underframe 17.

As shown in FIG. 1, a brake rigging 72 of conventional construction is utilized for both of the wheel trucks at opposite ends of the car. The rigging 72 comprises a brake actuating rod 73 which is connected at one end to the lever 69 to be actuated thereby. The rod 73 is pivotally connected to the live lever 75 in turn provided in the combination 76 of a brake and brake beam assembly. This brake beam assembly, is suitably supported on the trucks (by means of hangers). The live lever 75 is connected to a dead lever 77 by a brake connecting rod 78. The dead lever 77 is connected to a bracket 80, supported on the truck bolster 20 by means of an anchoring rod 79. On the B end of the car, of course, the same brake rigging 72 is provided. In this case the vertical lever, similar to the lever 69, is designated at 81 and is suitably pivoted at 82 on a bracket 84 suitably supported on the underframe in a similar manner to the bracket 69. The vertical lever 81 is connected at its lower end to the adjacent connecting brake actuating rod 73 which in turn functions with the live lever 75 in the same manner as indicated above.

Upon extension of the piston rod 37 the floating lever 51 and slack adjustor lever 57 is moved to the right when viewing the diagram of FIG. 4. The effect of this movement on the braking system at the A end of the car causes the rod 63 to be moved to the right, thereupon pivoting the horizontal lever 64 which in turn moves the lever rod 67 to the left, thereby pivoting the lever 69 causing movement of the rod 73 to the right which in turn applies the brake shoe and braking arrangement 76 to brake one of the sets of wheels on the truck. Simultaneously, the rod 78 causes braking action on the other wheels of the truck.

The wheel truck at the B end of course functions in a similar manner in that upon movement of the floating lever 51 in response to extension of the cylinder piston the rod 61 moves to the right, in turn pivoting the lever 81 moving the lever 73 to the left, causing braking of the sets of wheels.

Thus it is believed clear that the type of braking system disclosed in FIG. 4 and the positioning of the various portions of the novel system as indicated in FIGS. 1 through 3 provides for effective equalized braking at both ends of the car and the combination of components are so situated as to be out of the way of the opening doors. Further, a body mounted brake system is provided so that the sill-less hopper car can utilize the advantages of such a rigging without the expense entailed with truck mounted braking systems requiring many numerous air lines and service maintenance which is not required with the present type of system.

It is of course clear that the hand wheel may be also manually operated to swing the vertical lever 39 causing movement of the floating levers and providing for setting of the brakes in the event that a car is to be parked without the need of air cylinder application.

What is claimed is:

1. A car body mounted brake rigging for a railway hopper car having a body with hoppers and side sills extending longitudinally in laterally spaced flanking relation to the hoppers, said hopper having sloping ends and side sheets for discharging material downwardly unobstructedly between said side sills, an underframe supporting said body including horizontally spaced stub sills disposed at opposite ends of said hoppers, horizontal support means on each of said stub sills wheel trucks including truck bolsters supporting said body, the improvement of the car body mounted brake rigging arrangement unobstructive of the discharge ends of the hoppers, comprising a brake actuating cylinder supported by one of said support means at one end of said car beneath the sloping end sheet of one of said hoppers, means on said one support means for actuating said brake actuating cylinder, a first horizontal floating lever movably mounted on said one support means and including means connected to said actuating cylinder and movable thereby, said first horizontal lever having opposite ends disposed laterally outwardly on opposite sides of said cylinder, first and second actuating rods pivotally connected to opposite ends of said first horizontal lever, said first rod overlying one of said side sills and extending longitudinally, toward the other end of said car alongside said hoppers, a second horizontal lever pivotally supported on the support means on the other end of said car, means pivotally connecting one end of said second lever to said first actuating rod, and disposed immediately adjacent said one side sill, a first vertical lever pivotally supported on said car adjacent one side sill, a third rod pivotally connected to said second horizontal lever and to said first vertical lever, a second vertical lever pivotally supported on said car laterally inwardly with respect to said first vertical lever, pivotal means connecting said second vertical lever to said second rod, an end brake beam and brake shoe arrangement for each wheel truck supported thereon, and a first brake lever connecting rod connected to each of said vertical levers and to said end brake beam and brake shoe arrangement.

2. The brake rigging arrangement in accordance with claim 1, said first rod being disposed over said one side sill and below one of said sloping side sheets.

3. The brake rigging arrangement in accordance with claim 1, said first and second actuating rods being disposed above said stub sills and below said sloping end sheets.

4. The brake rigging arrangement in accordance with claim 1, including a slack adjusting lever pivotally connected to said first horizontal floating lever at one end and to said second actuating rod, and means pivotally connecting another end of said slack adjusting lever to said first actuating rod.

5. The brake rigging arrangement in accordance with claim 4, said means pivotally connecting said slack adjusting lever to said first actuating rod including a slack adjuster.

6. The brake rigging arrangement in accordance with claim 1, said means connected to said actuating cylinder including a cylinder lever pivotally supported on said support means and being connected to said actuating cylinder.

7. The brake rigging arrangement in accordance with claim 6 said cylinder including a piston rod and said cylinder lever being pivotally connected to said piston rod.

8. The brake rigging arrangement in accordance with claim 7, including a hand wheel arrangement supported at one end of said car in proximity to said vertical lever, and a flexible tension element connecting said hand wheel arrangement to said cylinder lever.

9. The brake rigging in accordance with claim 1, said horizontal support means including horizontal shear plates supported on said stub-sills.

10. The brake rigging in accordance with claim 1, each brake shoe and brake beam arrangement including a pair of brake beams having brake shoes mounted thereon, a live brake lever mounted on one brake beam, a dead brake lever mounted on the other brake beam, a second brake lever connecting rod connecting said live and dead levers, one of said first brake lever connecting rods being pivotally connected to each said live lever.

11. In a railway hopper car having side sills, an underframe supporting a hopper and including stub sills horizontally spaced at each car end between the side sills extending longitudinally of the car, wheel trucks including truck bolsters, said hopper having sloping ends and side sheets for discharging material downwardly, and horizontal support means disposed on top of each stub sill, a brake rigging arrangement comprising:

a brake actuating cylinder supported by said support means at one end of the car, a power supply means for actuating said brake actuating cylinder disposed on said support means at one end of the car, a horizontal floating lever being operatively connected with said brake actuating cylinder said horizontal floating lever having each end disposed transversely and oppositely outwardly of said cylinder, first and second actuating rods pivotally connected to opposite ends of said horizontal floating lever, said first actuating rod extending longitudinally and immediately adjacent and overlying one of said side sills, toward the other end of said car, a third horizontal rod operatively associated and longitudinally movable at the other end of the car by said first actuating rod, said second actuating rod and said third horizontal rod being pivotally connected to associated vertical levers disposed at opposite ends of the car, and a generally horizontal brake connecting rod pivotally attached to each vertical lever and to an associated brake shoe and brake beam arrangement at the corresponding ends of the car.

12. The brake rigging arrangement in accordance with claim 11, and a second horizontal lever pivotally connected to said first actuating rod at one end and to said third rod at another end, said second lever comprising means for pivotal connection with said support means.

13. The brake rigging arrangement in accordance with claim 11, and said first actuating rod comprising a slack adjuster.

14. The brake rigging arrangement in accordance with claim 13, and a slack adjuster lever pivotally connected to said second actuating rod at one end and to said first actuating rod at another end, means for sliding support of said slack adjuster lever being mounted on said support means, and means for connecting said slack adjuster with said slack adjuster lever at said other end.

15. The brake rigging arrangement in accordance with claim 11, and a cylinder lever pivotally mounted at one end of said support means and pivotally connected with said actuating cylinder at another end, means for connecting a middle portion of said cylinder lever with a middle portion of said floating lever.

16. The brake rigging arrangement in accordance with claim 15, and said cylinder lever being pivotally and flexibly connected to a hand wheel assembly at said other end.

* * * * *